US009248665B2

(12) United States Patent
Yamada

(10) Patent No.: US 9,248,665 B2
(45) Date of Patent: Feb. 2, 2016

(54) LIQUID DISCHARGE DEVICE AND AIR BLOWING METHOD

(71) Applicant: SEIKO EPSON CORPORATION, Tokyo (JP)

(72) Inventor: Jun Yamada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 81 days.

(21) Appl. No.: 13/863,604

(22) Filed: Apr. 16, 2013

(65) Prior Publication Data

US 2013/0293650 A1 Nov. 7, 2013

(30) Foreign Application Priority Data

May 2, 2012 (JP) ..... 2012-105151

(51) Int. Cl.
*B41J 2/01* (2006.01)
*B41J 11/00* (2006.01)

(52) U.S. Cl.
CPC ..... *B41J 11/0015* (2013.01); *B41J 11/002* (2013.01)

(58) Field of Classification Search
None
See application file for complete search history.

(56) References Cited

U.S. PATENT DOCUMENTS

| | | | | |
|---|---|---|---|---|
| 2009/0021549 | A1* | 1/2009 | Muto | 347/16 |
| 2009/0303285 | A1* | 12/2009 | Matsuhashi | 347/37 |
| 2010/0188469 | A1* | 7/2010 | Ikegami | 347/102 |
| 2011/0037819 | A1* | 2/2011 | Mizutani | 347/108 |
| 2012/0218329 | A1* | 8/2012 | Takahashi | 347/9 |

FOREIGN PATENT DOCUMENTS

JP 2005-246908 A 9/2005

* cited by examiner

*Primary Examiner* — Geoffrey Mruk
*Assistant Examiner* — Bradley Thies
(74) *Attorney, Agent, or Firm* — Global IP Counselors, LLP

(57) ABSTRACT

A liquid discharge device includes a platen, a head unit and an air blower. The platen is configured and arranged to support a medium. The head unit is configured and arranged to discharge liquid on the medium supported by the platen. The air blower is configured and arranged to send air toward the medium supported by the platen. The air blower is attached to the liquid discharge device such that the air sent by the air blower toward the medium flows in a direction at an angle to a normal line direction of the medium.

6 Claims, 11 Drawing Sheets

| | Wait between Passes | | Wait between Layers |
|---|---|---|---|
| | Background Image Recording Pass | Color Image Recording Pass | |
| Surface Printing | $T_3$ | $T_1$ | $T_5$ |
| Back Surface Printing | $T_2$ | $T_1$ | $T_4$ |

$(T_1<T_2<T_3<T_4<T_5)$

LIQUID DISCHARGE DEVICE AND AIR BLOWING METHOD

CROSS-REFERENCE TO RELATED APPLICATIONS

This application claims priority to Japanese Patent Application No. 2012-105151 filed on May 2, 2012. The entire disclosure of Japanese Patent Application No. 2012-105151 is hereby incorporated herein by reference.

BACKGROUND

1. Technical Field

The present invention relates to a liquid discharge device and air blowing method.

2. Related Art

A liquid discharge having a platen for supporting a medium and a head unit for discharging liquid on the medium supported by the platen is already known. Inkjet printers are an example of this kind of liquid discharge device (for example, Japanese Laid-Open Patent Application Publication No. 2005-246908).

SUMMARY

However, among this kind of liquid discharge device, there are items equipped with air blowers for sending air toward the medium supported by the platen provided on the head unit in order to dry the liquid discharged on the medium.

However, when the air blower operated, there were cases when locations at which the liquid had not suitably dried occurred on the medium.

The present invention was created considering this problem, and an object is to suitably dry the liquid.

A liquid discharge device according to one aspect includes a platen, a head unit and an air blower. The platen is configured and arranged to supporting a medium. The head unit is configured and arranged to discharge liquid on the medium supported by the platen. The air blower is configured and arranged to send air toward the medium supported by the platen. The air blower is attached to the liquid discharge device such that the air sent by the air blower toward the medium flows in a direction at an angle to a normal line direction of the medium.

Other features of the present invention will become clearer from the descriptions in this specification and the attached drawings.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
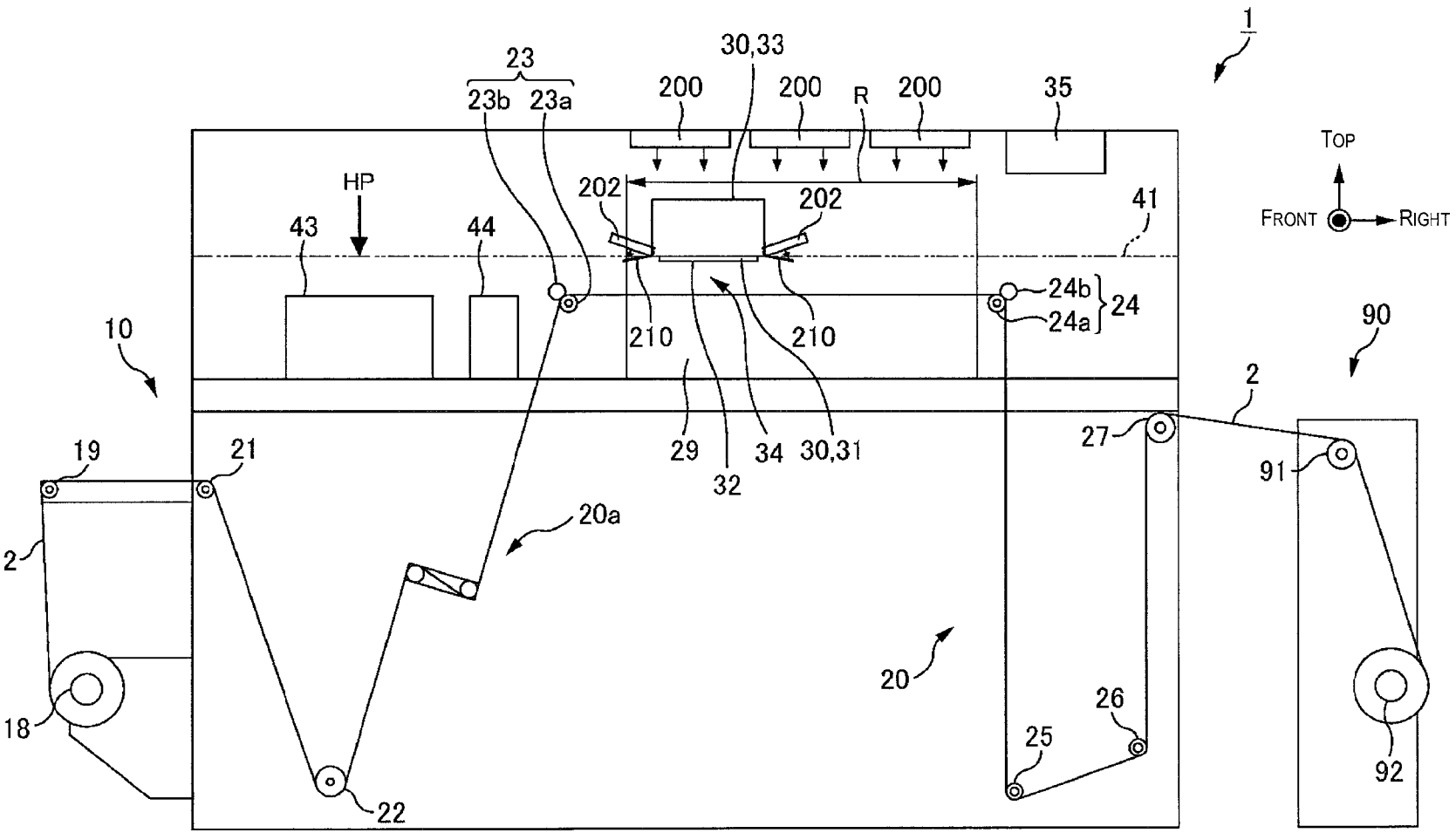
FIG. 1 is a schematic drawing showing the constitution of an image recording device 1.

At least the following points will become clearer from the descriptions in this specification and the attached drawings.

A liquid discharge device according to one embodiment includes a platen, a head unit and an air blower. The platen is configured and arranged to supporting a medium. The head unit is configured and arranged to discharge liquid on the medium supported by the platen. The air blower is configured and arranged to send air toward the medium supported by the platen. The air blower is attached to the liquid discharge device such that the air sent by the air blower toward the medium flows in a direction at an angle to a normal line direction of the medium.

With this liquid charge device, it is possible to suitably dry a liquid.

In the liquid discharge device according the embodiment, a bottom surface of the head unit preferably includes a nozzle surface having a plurality of nozzles configured and arranged to discharge the liquid. The liquid discharge device preferably further includes an air blocking unit configured and arranged to suppress sending of air to a space between the nozzle surface and the medium by blocking the air.

In this case, it is possible to suitably inhibit the occurrence of flight curve of the liquid.

The liquid discharge device according the embodiment preferably further includes a conveyor part configured and arranged to convey the medium in a conveyance direction. The air blower is preferably attached to a side edge part of the head unit with respect to the conveyance direction. The air blocking unit is preferably a windbreak plate. The windbreak plate preferably has a downward extension plate extending from the head unit and positioned below the air blower.

In this case, it is possible to effectively suppress sending of the air to the space.

In the liquid discharge device according the embodiment, the windbreak plate preferably further includes a first side edge part opposing plate connected to the downward extension plate and facing one of side edge parts of the air blower in a width direction of the medium intersecting the conveyance direction, and a second side edge part opposing plate connected to the downward extension plate and facing the other one of the side edge parts of the air blower in the width direction. The air blower is preferably surrounded from both sides and underneath by the downward extension plate, the first side edge part opposing plate, and the second side edge part opposing plate. A distance between front edge parts of the first side edge part opposing plate and the second side edge part opposing plate is preferably greater than a distance between base parts of the first side edge part opposing plate and the second side edge part opposing plate.

In this case, it is possible to more suitably dry the liquid.

In the liquid discharge device according the embodiment, the air blower is preferably attached to be able to freely move relative to the head unit in a width direction of the medium intersecting with the conveyance direction.

In this case, it is possible to more suitably dry the liquid.

In the liquid discharge device according the embodiment, the air blower is preferably a moving air blower. The liquid discharge device preferably further includes a fixed air blower fixed to a liquid discharge device main unit to send air toward the medium supported by the platen, and a second air blocking unit configured and arranged to suppress sending of the air to the space by blocking the air sent by the fixed air blower.

In this case, it is possible to suitably inhibit the occurrence of flight curve of the liquid.

An air blowing method according to one embodiment includes: preparing a liquid discharge device having a platen for supporting a medium, a head unit for discharging liquid on the medium supported by the platen, and an air blower for sending air toward the medium supported by the platen; and sending the air by the air blower diagonally downward at an angle to a normal line direction of the medium.

With this air blowing method, it is possible to suitably dry the liquid.

Configuration Example of Image Recording Device 1

Figure 2:
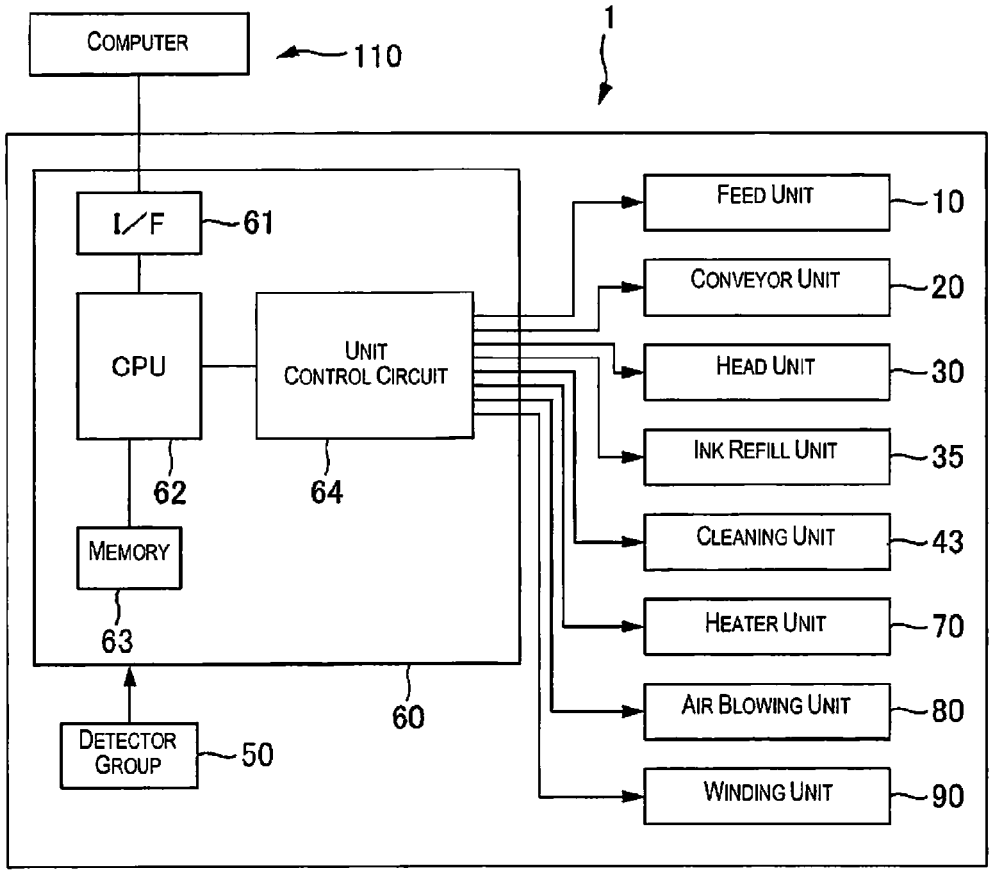
FIG. 2 is a block diagram showing the constitution of the image recording device 1.

We will use FIG. 1 and FIG. 2 to describe a configuration example of the image recording device 1 as an example of the liquid discharge device (with this embodiment, an inkjet printer, and particularly, a lateral scan type label printing apparatus). FIG. 1 is a schematic cross section view of the image recording device 1. FIG. 2 is a block diagram of the image recording device 1.

With the description below, when using the terms "vertical direction" and "horizontal direction," these indicate items with the directions shown by the arrows in FIG. 1 as the reference. Also, when using the term "front-back direction," this indicates an item with the direction orthogonal to the paper surface in FIG. 1.

Also, with this embodiment, as an example of the medium on which the image recording device 1 records an image, we will give a description using a transparent media rolled into a roll form (hereafter referred to as rolled transparent media 2).

As shown in FIG. 1 and FIG. 2, the image recording device 1 of this embodiment has a conveyor unit 20 as an example of the conveyor part, a head unit 30 which has a feed unit 10, a platen 29, and a winding unit 90 along a conveyance path on which the conveyor unit 20 conveys the rolled transparent media 2 (in FIG. 1, represented by the part at which the rolled transparent media 2 is positioned from a rolled transparent media winding shaft 18 up to a rolled transparent media winding drive shaft 92) and furthermore, performs image recording by discharging ink as an example of a plurality of types of liquid in an image recording area Ron the conveyance path, an ink refill unit 35, a carriage unit 40, a cleaning unit 43, a heater unit 70, an air blowing unit 80 that blows air to the rolled transparent media 2 on the platen 29, a controller 60 that controls these units and the like and manages their operation as the image recording device 1, and a detector group 50.

The feed unit 10 feeds the rolled transparent media 2 to the conveyor unit 20. This feed unit 10 has the rolled transparent media winding shaft 18 on which the rolled transparent media 2 is wound and which is supported to be able to rotate, and a relay roller 19 for winding the rolled transparent media 2 let out from the rolled transparent media winding shaft 18 and leading it the conveyor unit 20.

The conveyor unit 20 conveys the rolled transparent media 2 sent from the feed unit 10 in the conveyance direction along a preset conveyance path. As shown in FIG. 1, this conveyor unit 20 has a relay roller 21 positioned horizontally to the right in relation to the relay roller 19, a relay roller 22 positioned diagonally downward to the right seen from the relay roller 21, a first conveyor roller 23 positioned diagonally upward to the right seen from the relay roller 22 (left side in the conveyance direction seen from the platen 29), a steering unit (navigation unit) 20*a* positioned between the relay roller 22 and the first conveyor roller 23, a second conveyor roller 24 positioned to the right seen from the first conveyor roller 23 (right side in the conveyance direction seen from the platen 29), a reverse roller 25 positioned vertically downward seen from the second conveyor roller 24, a relay roller 26 positioned to the right seen from the reverse roller 25, and a delivery roller 27 positioned upward seen from the relay roller 26.

The relay roller 21 is a roller that winds the rolled transparent media 2 sent from the relay roller 19 from the left and slackens it facing downward.

The relay roller 22 is a roller that winds the rolled transparent media 2 sent from the relay roller 21 from the left and conveys it diagonally upward to the right.

The first conveyor roller 23 has a first drive roller 23*a* driven by a motor (not illustrated), and a first driven roller 23*b* arranged so as to sandwich the rolled transparent media 2 and face opposite that first drive roller 23*a*. This first conveyor roller 23 is a roller that pulls the downwardly slackened rolled transparent media 2 upward, and conveys it to the image recording area R facing opposite the platen 29. The first conveyor roller 23 temporarily stops conveying during the time that image printing is being implemented on a site of the rolled transparent media 2 on the image recording area R (specifically, as described later, one page of image recording is achieved at that site by the head 31 discharging ink at that site of the stopped rolled transparent media 2 while moving in the horizontal direction and the front-back direction). Through drive control by the controller 60, by the first driven roller 23*b* rotating in accordance with the rotational drive of the first drive roller 23*a*, the conveyance volume of the rolled transparent media 2 positioned on the platen 29 is adjusted.

As described above, the conveyor unit 20 has a mechanism that slackens downward the site of the rolled transparent media 2 wound between the relay rollers 21 and 22 and the first conveyor roller 23 and conveys it. This slacking of the rolled transparent media 2 is monitored by the controller 60 based on detection signals from a slack detection sensor (not illustrated). In specific terms, when a site of the rolled transparent media 2 slackened between the relay roller 21 and 22 and the first conveyor roller 23 is detected by the slack detection sensor, a suitable level of tensile force is given to that site, so the conveyor unit 20 is able to convey the rolled transparent media 2 in a slackened state. Meanwhile, when a slackened site of the rolled transparent media 2 is not detected by the slack detection sensor, excessively large tensile force is given to that site, so conveying of the rolled transparent media 2 by the conveyor unit 20 is temporarily stopped, and the tensile force is adjusted to a suitable level.

As shown in FIG. 1, the steering unit 20*a* is positioned on the conveyance path in a tilted state, and is for changing the width direction position of the rolled transparent media 2 (the position at which the rolled transparent media 2 is positioned in the width direction (front-back direction shown in FIG. 1)) by rotating. Specifically, when the rolled transparent media 2 is conveyed along the conveyance path, there are cases when the width direction position of the rolled transparent media 2 is displaced due to things such as axial skew, attachment error or the like of the relay roller or the like, or variation in the tensile strength that acts on the rolled transparent media 2. Then, that steering unit 20*a* is for adjusting that width direction position of the rolled transparent media 2.

The second conveyor roller 24 has a second driver roller 24*a* driven by a motor (not illustrated), and a second driven roller 24*b* arranged so as to sandwich the rolled transparent media 2 facing opposite that second drive roller 24*a*. This second conveyor roller 24 is a roller that conveys a site of the rolled transparent media 2 after the image is recorded by the head unit 30 vertically downward after being conveyed in the horizontally right direction along the support surface of the platen 29. By doing this, the direction of the rolled transparent media 2 is changed. The second driven roller 24*b* rotates along with the rotational drive of the second drive roller 24*a* by the drive control of the controller 60, and the designated tensile force given to the site of the rolled transparent media 2 positioned on the platen 29 is adjusted.

The reverse roller 25 is a roller that winds the rolled transparent media 2 sent from the second conveyor roller 24 from the upper left side and conveys it diagonally right and downward.

The relay roller 26 is a roller that winds the rolled transparent media 2 sent from the reverse roller 25 from the lower left side and conveys it upward.

The delivery roller 27 winds the rolled transparent media 2 sent from the relay roller 26 from the lower left side and sends it to the winding unit 90.

In this way, the conveyance path for conveying the rolled transparent media 2 is formed by moving the rolled transparent media 2 in sequence via each roller. The rolled transparent media 2 is transported along that conveyance path intermittently in area units corresponding to the image recording area R (specifically, the conveyance is performed intermittently for each one page of image recording at a site of the rolled transparent media 2 on the image recording area R).

The head unit 30 is for recording an image on the site of the rolled transparent media 2 positioned at the image recording area R on the conveyance path. Specifically, the head unit 30 discharges ink from the ink discharge nozzles (correlating to nozzles) and forms an image on the site of the rolled transparent media 2 sent by the conveyor unit 20 to the image recording area R on the conveyance path (on the platen 29). This head unit 30 has a head 31 and a carriage 33.

A nozzle surface 32 having ink discharge nozzles for discharging ink is provided on the bottom surface of the head unit 30 (head 31). Then, the head 31 has ink discharge nozzle rows for which ink discharge nozzles are aligned in the row direction on that nozzle surface 32. With this embodiment, for each color yellow (Y), magenta (M), cyan (C), black (K), and white (W), there is an ink discharge nozzle row consisting of a plurality of ink discharge nozzles #1 to #N. Each ink discharge nozzle #1 to #N of each ink discharge nozzle row is aligned in a straight line in the intersecting direction that intersects with the conveyance direction of the rolled transparent media 2 (in other words, that intersecting direction is the row direction described previously). Each ink discharge nozzle row is arranged in parallel with a gap opened to each other along the applicable conveyance direction.

On each ink discharge nozzle #1 to #N is provided a piezo element (not illustrated) as a drive element for discharging ink drops. When voltage of a designated duration is applied between electrodes provided at both ends, the piezo element expands according to the voltage application time, and deforms that side wall of the ink flow path. By doing this, the volume of the ink flow path contracts according to the expansion of the piezo element, and the ink correlating to this contraction amount becomes ink drops and is discharged from the ink discharge nozzles #1 to #N of each color.

The carriage 33 is constituted so as to be an integral unit with the head 31 and moves along the carriage guide rail 41 (shown by double-dot-dash lines in FIG. 1) in the conveyance direction (horizontal direction) driven by a motor (not illustrated). Specifically, the carriage 33 is made to support the head 31 and move back and forth in the conveyance direction (horizontal direction) along with the movement of the head 31. Also, a head guide rail (not illustrated) is provided extending in the row direction (front-back direction) on the carriage 33, and the constitution is such that the head 31 moves in the row direction (front-back direction) along that head guide rail by the drive of the motor.

In this way, the head 31 is made to be able to move back and forth in the conveyance direction (specifically, the horizontal direction) and the row direction (specifically, the front-back direction).

The ink refill unit 35 is for refilling ink in the head 31 when the volume of ink within the head 31 has decreased due to discharging of ink by the head 31.

This ink refill unit 35 is provided for each ink color. Specifically, provided are a yellow ink refill unit for refilling yellow colored ink, a magenta ink refill unit for refilling magenta colored ink, a cyan ink refill unit for refilling cyan colored ink, a black ink refill unit for refilling the black colored ink, and a white ink refill unit for refilling the white colored ink.

The ink refill unit 35 is constituted from a large number of tubes that become the ink flow paths (passages) and a large number of valves and the like for opening and closing those tubes. The locations at which those ink cartridges are arranged are expressed by code number 35 in FIG. 1.

The cleaning unit 43 is for cleaning the head 31. This cleaning unit 43 is provided at a home position (hereafter referred to as HP, see FIG. 1), and has a cap, a suction pump and the like. When the head 31 (carriage 42) is moved in the conveyance direction (horizontal direction) and positioned at the HP, the cap (not illustrated) is made to seal tightly on the bottom surface of the head 31 (nozzle surface 32). When the suction pump is operated in a state with the cap tightly sealed in this way, the ink within the head 31 is suctioned together with thickened ink and paper dust. Working in this way, cleaning of the head 31 is completed by the clogged ink discharge nozzle recovering from a non-discharge state.

Also, a flushing unit 44 is provided between the HP and the platen 29 in the conveyance direction (horizontal direction), and when the head 31 (carriage 42) moves in the conveyance direction (horizontal direction) and is positioned at a position facing opposite the flushing unit 44, the head 31 executes a flushing operation by which ink is discharged and flushed from each ink discharge nozzle belonging to the ink discharge nozzle row.

The platen 29 is for supporting and heating the rolled transparent media 2. Specifically, the platen 29 supports the site of the rolled transparent media 2 positioned at the image recording area Ron the conveyance path and heats that site. As shown in FIG. 1, this platen 29 is provided corresponding to the image recording area R on the conveyance path, and is arranged at an area along the conveyance path between the first conveyor roller 23 and the second conveyor roller 24. Then, the platen 29 is able to heat that site of the rolled transparent media 2 by receiving supply of the heat generated by the heater unit 70.

The heater unit 70 is for heating the rolled transparent media 2, and has a heater (not illustrated). This heater has nichrome wires, and is constituted such that those nichrome wires are arranged inside the platen 29 so as to be a fixed distance from the support surface of the platen 29. Because of that, with the heater, by being made conductive, the nichrome wires themselves are heated, and it is possible to conduct heat to the site of the rolled transparent media 2 positioned above the support surface of the platen 29. This heater is constituted with nichrome wires built into the entire area of the platen 29, so it is possible to evenly conduct heat to the site of the rolled transparent media 2 on the platen 29. With this embodiment, that site of the rolled transparent media 2 is heated evenly such that the temperature of the site of the rolled transparent media 2 on the platen is 45° C. By doing this, it is possible to dry the ink that has impacted that site of the rolled transparent media 2.

The air blowing unit 80 is for drying the ink discharged on that site by sending air to the site of the rolled transparent media 2 on the platen 29, working in cooperation with the platen 29 (heater unit 70). The air blowing unit 80 will be described in detail later.

The winding unit 90 is for winding the rolled transparent media 2 sent by the conveyor unit 20 (the rolled transparent media on which an image is already recorded). This winding unit 90 has a relay roller 91 for conveying the rolled transparent media 2 sent from the delivery roller 27 diagonally downward to the right winding from the left side upward, and a rolled transparent media winding drive shaft 92 for winding up the rolled transparent medias 2 sent from the relay roller 91 supported to be able to rotate.

The controller 60 is a control unit for performing control of the image recording device 1. As shown in FIG. 2, this controller 60 has an interface unit 61, a CPU 62, a memory 63, and a unit control circuit 64. The interface unit 61 is for performing data sending and receiving between the host computer 110 which is an external device and the image recording device 1. The CPU 62 is an arithmetic processing device for performing overall control of the image recording device 1. The memory 63 is for ensuring the area for storing the programs of the CPU 62, a work area and the like. The CPU 62 controls each unit by a unit control circuit 64 according to the programs stored in the memory 63.

The detector group 50 is for monitoring the status within the image recording device 1, and for example includes the slack detection sensor described above, a rotary encoder attached to the conveyor roller and used for control of conveying of the rolled transparent media 2 and the like, a paper detection sensor for detecting whether or not there is conveyed rolled transparent media 2, a linear encoder for detecting the position in the conveyance direction (horizontal direction) of the carriage 33 (or the head 31), a paper end position detection sensor for detecting the paper end (edge) position in the width direction of the roller transparent media 2, and the like.

Air Blowing Unit 80

Figure 3:
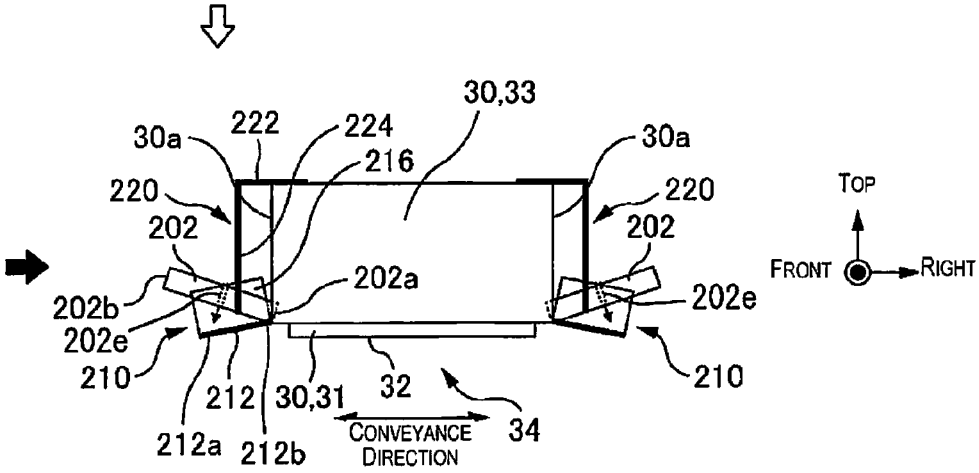
FIG. 3 is a first pattern diagram showing the constitution of the on-carriage fan 202 and the peripheral members in its periphery.
Figure 4:
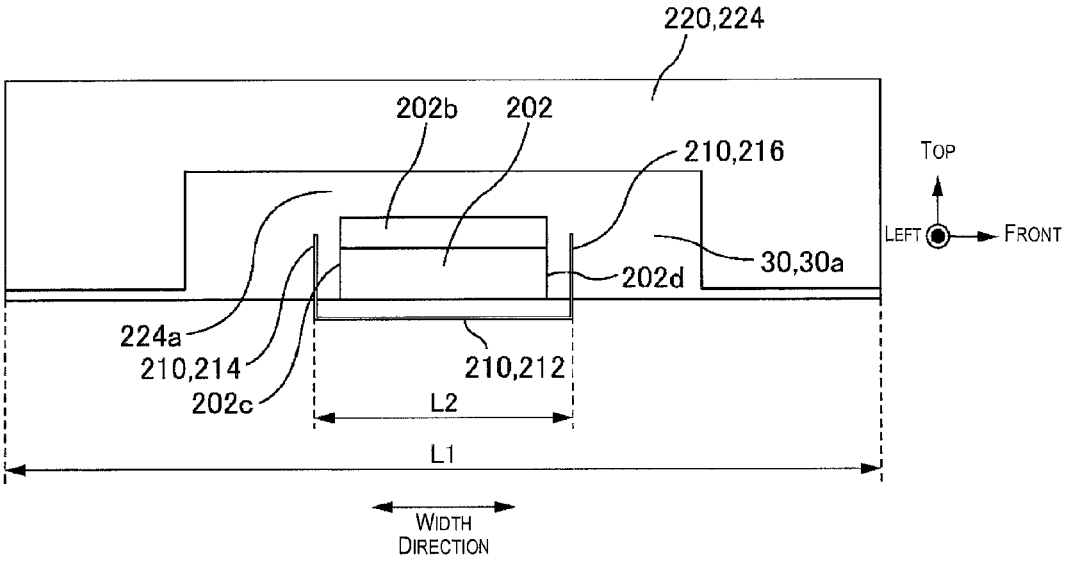
FIG. 4 is a second pattern diagram showing the constitution of the on-carriage fan 202 and the peripheral members in its periphery.
Figure 5:
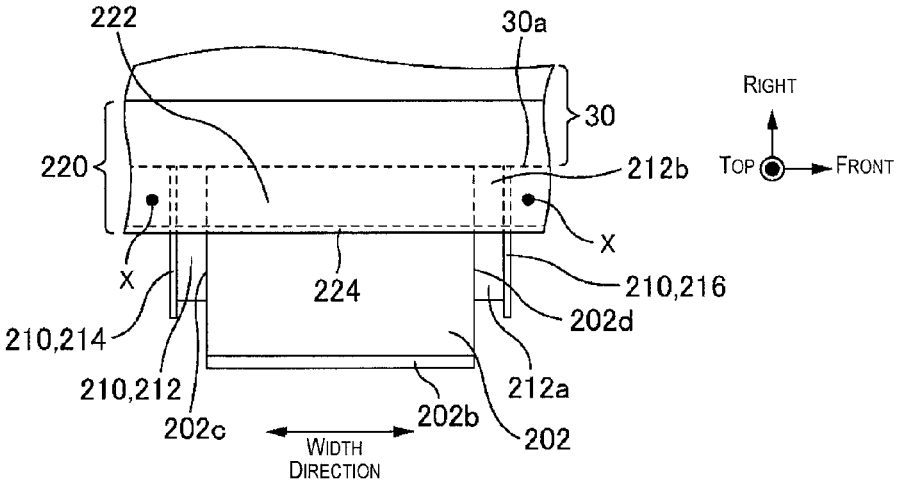
FIG. 5 is a third pattern diagram showing the constitution of the on-carriage fan 202 and the peripheral members in its periphery.

Next, we will describe the air blowing unit 80 using FIG. 1, and FIG. 3 through FIG. 5. FIG. 3 through FIG. 5 are pattern diagrams showing the constitution of the on-carriage fan 202 and the peripheral members in its periphery. FIG. 4 is a drawing of these members seen from the direction of the thick black arrow in FIG. 3. FIG. 5 is a drawing of these members seen from the direction of the thick white arrow in FIG. 3.

To make the drawings easier to understand, notation of the first side plate 214, the second side plate 216, and the ceiling fan windbreak plate 220 in FIG. 1, as well as notation of the head 31 in FIG. 4 are omitted.

As described previously, by sending air to a site of the rolled transparent media 2 on the platen 29, the air blowing unit 80 is for drying the ink discharged on that site. This air blowing unit 80 has a ceiling fan 200 as an example of a fixed air blower fixed to the image recording device main unit, an on-carriage fan 202 as an example of a moving air blower, a windbreak plate 210 as an example of an air blocking unit, and a ceiling fan windbreak plate 220 as an example of a second air blocking unit.

The ceiling fan 200 sends air (ventilates) toward the site of the rolled transparent media 2 on the platen 29 by rotating, and dries the ink impacted on that site. This ceiling fan 200 is an axial flow fan, and as shown in FIG. 1, there are a plurality of them provided on the image recording device main unit (in specific terms, a cover (not illustrated) capable of opening and closing that is provided on the image recording device main unit). Then, as shown in FIG. 1, when the cover is closed, these ceiling fans 200 are positioned above the platen 29, and are made to face opposite the support surface of that platen 29 (the rolled transparent media 2 on that platen 29). Then, the ceiling fan 200 sends air downward toward the rolled transparent media 2 supported by the opposite facing platen 29 (the air direction is shown by the arrow attached to the ceiling fan 200 in FIG. 1).

Similar to the ceiling fan 200, the on-carriage fan 202 also sends air (ventilates) toward the site of the rolled transparent media 2 on the platen 29 by rotating, and dries the ink impacted on that site. This on-carriage fan 202 is also an axial flow fan, and two of these are provided on the head unit 30 (with this embodiment, the carriage 33 of the head unit 30). Specifically, as shown in FIG. 1 and FIG. 3, one of the on-carriage fans 202 is equipped further to the left than the head unit 30 in the conveyance direction, and the other on-carriage fan 202 is equipped further to the right side than the head unit 30 in the conveyance direction. With this embodiment, the two on-carriage fans 202 always operate simultaneously (there is no operation of just one alone). The constitution of the two on-carriage fans 202 is the same, so hereafter, we will describe one on-carriage fan 202.

As shown in FIG. 3 through FIG. 5, the on-carriage fan 202 has a roughly rectangular solid shape. Also, as shown in FIG. 3, the on-carriage fan 202 is attached to the bottom edge part of the side edge part 30*a* of the head unit 30 in the conveyance direction (specifically, the side part of the head unit 30, and the edge of the head unit in the conveyance direction). Furthermore, the on-carriage fan 202 is equipped at the center part of the head unit 30 in the width direction of the rolled transparent media 2 intersecting with the conveyance direction (in other words, the front-back direction).

Furthermore, the on-carriage fan 202 is attached to the head unit 30 such that the direction of the air sent by the on-carriage fan 202 toward the rolled transparent media 2 (that air direction is shown by the arrow attached to the on-carriage fan 202 in FIG. 1 and FIG. 3) is a diagonally downward direction at an angle to the normal line direction of the rolled transparent media 2 (specifically, the vertical direction). In other words, the on-carriage fan 202 is provided such that the side surface 202*a* of the side close to the side edge part

30*a* in the conveyance direction of that on-carriage fan 202 is positioned further downward than the far side surface 202*b*, so the axis 202*e* of the on-carriage fan 202 which is an axial flow fan is tilted from the normal line direction (see the arrow attached to the on-carriage fan 202 in FIG. 1 and FIG. 3).

Since the on-carriage fan 202 is provided on the head unit 30 in this way, air is made to be sent toward the rolled transparent media 2 supported by the platen 29 while moving in that conveyance direction along with movement in the conveyance direction of the head unit 30 (head 31) (this point differs from the ceiling fan 200 which does not blow air while moving).

Also, the on-carriage fan 202 has its axis 202*e* tilted from the normal line direction, so rather than being downward, the air blows in a direction that is diagonally downward moving away from the head 31 (however, due to the existence of the windbreak plate 210 described later, the air sent diagonally downward by the on-carriage fan 202 does not necessarily progress directly to the site on the rolled transparent media 2 positioned in that diagonally downward direction (said another way, positioned on the axial extension of the on-carriage fan 202)). Also, since the on-carriage fan 202 is provided at the center in the width direction of the head unit 30, if the rolled transparent media 2 is an item of the maximum width, the air sent by the on-carriage fan 202 is made to face the center part of the width direction of that rolled transparent media 2.

By blocking air sent by the on-carriage fan 202, the windbreak plate 210 suppresses that air from being sent to the space 34 between the nozzle surface 32 and the rolled transparent media 2, acting to inhibit flight curve of ink droplets discharged from the ink discharge nozzles of the nozzle surface 32 toward the rolled transparent media 2. This windbreak plate 210 is a plate shaped member made of thin metal, and two of these are provided to correspond respectively to the two on-carriage fans 202 (since the constitution of the two windbreak plates 210 is the same, hereafter, we will describe one windbreak plate 210).

Also, as shown in FIG. 4, the windbreak plate 210 is equipped with a downward extension plate 212, a first side plate 214 as an example of a first side edge part opposing plate, and a second side plate 216 as an example of a second side edge part opposing plate.

As shown in FIG. 5, the downward extension plate 212 is attached to the head unit 30 so as to extend from the head unit 30 (with this embodiment, the carriage 33 of the head unit 30), and as shown in FIG. 3 and FIG. 4, is positioned below the on-carriage fan 202. Because of that, as shown in FIG. 3, the downward extension plate 212 is positioned between the on-carriage fan 202 and the space 34, blocks the air sent by the on-carriage fan 202, and effectively suppresses that air from being sent to the space 34. With this embodiment, as shown in FIG. 5, that downward extension plate 212 has a rectangular shape, and as shown in FIG. 3, the front edge part 212*a* is provided so as to be positioned slightly downward from the back edge part 212*b*.

As shown in FIG. 4, the first side plate 214 and the second side plate 216 are respectively a plate facing opposite the width direction with one side edge part 202*c* of the on-carriage fan 202 in the width direction, and a plate facing opposite the width direction with the other side edge part 202*d* of the on-carriage fan 202 in the width direction, and act to suppress the dispersion of the air sent by the on-carriage fan 202 in the width direction. As shown in FIG. 3, the first side plate 214 and the second side plate 216 have the same rectangular shape, and both are connected to the downward extension plate 212 (note that the angle formed with the downward extension plate 212 is a 90 degree angle). In specific terms, the bottom edge of the first side plate 214 is connected to one edge in the width direction of the downward extension plate 212 (left edge in FIG. 4), and the bottom edge of the second side plate 216 is connected to the other edge in the width direction of the downward extension plate 212 (right edge in FIG. 4). With this embodiment, the downward extension plate 212, the first side plate 214, and the second side plate 216 (specifically, windbreak plate 210) are single plates bent at right angles at two locations. (See FIG. 4. However, the invention is not limited to this, and can also be three different plates connected together.)

Then, as shown in FIG. 4, the on-carriage fan 202 is surrounded from both sides and the bottom by the windbreak plate 210, the downward extension plate 212, the first side plate 214, and the second side plate 216, and by doing this, the air sent by the on-carriage fan 202 is suitably guided by the windbreak plate 210 (in other words, such that the air does not reach the space 34).

By blocking the air sent by the ceiling fan 200, the ceiling fan windbreak plate 220 suppresses sending of that air to the space 34 between the nozzle surface 32 and the rolled transparent media 2, and acts to inhibit flight curve of ink droplets discharged from the ink discharge nozzles of the nozzle surface 32 toward the rolled transparent media 2. This ceiling fan windbreak plate 220 is a plate shaped member made of thin metal, and two of these are provided on the head unit 30. Specifically, as shown in FIG. 3, one of the ceiling fan windbreak plates 220 is provided further to the left side than the head unit 30 in the conveyance direction, and the other ceiling fan windbreak plate 220 is provided further to the right than the head unit 30 in the conveyance direction. The constitution of the two ceiling fan windbreak plates 220 is the same, so hereafter, we will describe one ceiling fan windbreak plate 220.

As shown in FIG. 3, the ceiling fan windbreak plate 220 is equipped with a side extension plate 222 and a notch plate 224.

As shown in FIG. 3, the side extension plate 222 is attached to the head unit 30 so as to extend to the side (conveyance direction) from the top surface of the head unit 30, and faces opposite the ceiling fan 200 beneath the ceiling fan 200. Because of that, the side extension plate 222 is made to block the air sent downward by the ceiling fan 200. In other words, if the ceiling fan windbreak plate 220 is not equipped, with FIG. 5, at the positions indicated by the code X (positions near the head unit 30 and the on-carriage fan 202 (windbreak plate 210)), the air from the ceiling fan 200 is moved downward (in FIG. 5, the direction piercing the paper surface), and after that, though there is the risk of that air circling around to the space 34, this is effectively suppressed by blocking of the wind by the side extension plate 222. With this embodiment, the side extension plate 222 has a rectangular shape, and the length of that side extension plate 222 in the width direction of the rolled transparent media 2 is the same as the length of the width direction of the head unit 30.

As shown in FIG. 3, the notch plate 224 is a plate facing opposite the conveyance direction with the side edge part 30*a* of the head unit 30, and acts to inhibit the entry of air from the side to the position shown by the symbol X by blocking air moving in the conveyance direction. As shown in FIG. 4, this notch plate 224 has a rectangular notch 224*a* below the rectangular plate so as to avoid physical interference with the on-carriage fan 202 and the windbreak plate 210, and is connected with the side extension plate 222 (the angle formed with the side extension plate 222 is approximately a 90 degree angle). In specific terms, the top edge of the notch plate 224 is connected with the edge of the side extension plate 222 in the conveyance direction. With this embodiment, the side extension plate 222 and the notch plate 224 (specifically, the ceiling fan windbreak plate 220) are single plates bent at right angles. (See FIG. 3. However, the invention is not limited to this, and it is also possible to connect two different plates together.)

Operation Example of Image Recording Device 1

As described above, the head 31 which has an ink discharge nozzle row in which ink discharge nozzles are aligned in the row direction (front-back direction) is provided on the image recording device 1 of this embodiment. Then, one page of image recording is performed on the site of the rolled transparent media 2 on the image recording area R by the controller 60 having that head 31 move in the conveyance direction (horizontal direction), discharging ink from the ink discharge nozzles, and forming raster lines along the conveyance direction (horizontal direction) (this, specifically this operation, is called an image recording pass or simply a pass).

Here, the controller 60 of this embodiment executes printing with a plurality of passes (4 passes, 6 passes, 8 passes or the like). Specifically, to increase the resolution of the image in the row direction, the position of the head 31 is changed a little bit each time in the row direction with each pass to perform printing. Also, as an image forming method, for example, well known interlace (microweave) printing is executed.

Figure 6:
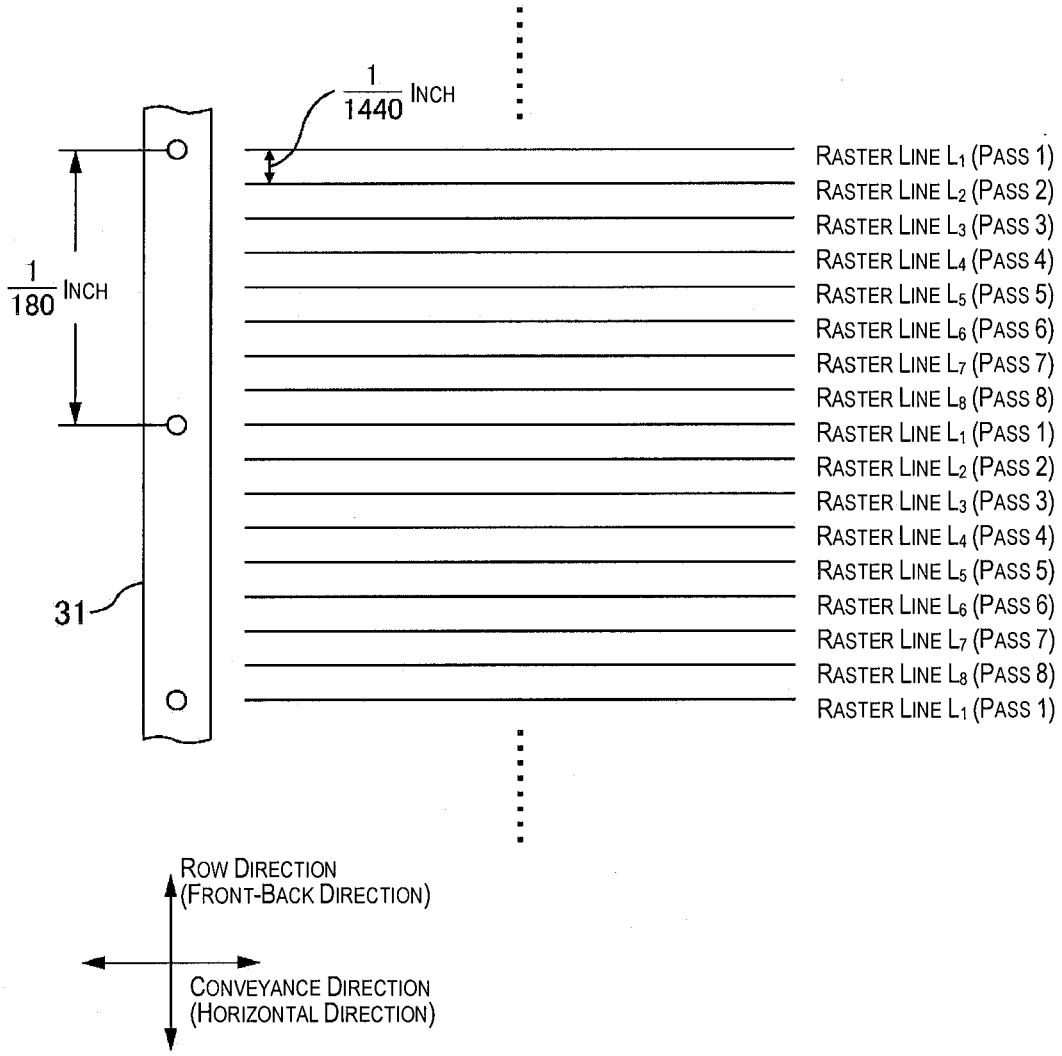
FIG. 6 is a pattern diagram showing the raster lines formed with each pass in a case when printing with 8 passes.

We will describe this in specific terms using FIG. 6. FIG. 6 is a pattern diagram shown the raster lines formed with each pass in a case of printing with 8 passes.

The ink discharge nozzle row (ink discharge nozzles) of the head 31 are represented at the left side in FIG. 6, and by ink being discharged from the ink discharge nozzles while that head 31 (ink discharge nozzle row) is moved in the conveyance direction, raster lines are formed. The position in the row direction of the head 31 (ink discharge nozzle row) represented in the drawing is the position at the time of the first pass, and when the head 31 (ink discharge nozzle row) is moved with that position maintained as is in the conveyance direction, the first pass of printing is executed, and three raster lines represented in the drawing (raster line L1 for which pass 1 is written at the right edge) are formed. In FIG. 6, to make the drawing easier to understand, a straight line raster line with no breaks is represented, but of course, when there is no printing data, break parts could occur in the raster lines.

Next, the head 31 (ink discharge nozzle row) moves in the row direction, and when the head 31 (ink discharge nozzle row) moves in the conveyance direction with the position after moving maintained as is, printing of the second pass is executed, and the two raster lines represented in the drawing (raster lines L2 for which pass 2 is written at the right edge) are formed. Note that because interlace (microweave) printing is being used, the raster lines L2 adjacent to the raster lines L1 are formed with ink discharged from a different ink discharge nozzle than the ink discharge nozzle from which ink was discharged to form the raster lines L1. Because of that, the movement distance in the row direction of the head 31 (ink discharge nozzle row) is not ⅛ of the distance between nozzles (e.g. 1/180 inch) ($1/180 \times 1/8 = 1/1440$ inch), but rather a larger distance than that (hereafter, this distance is referred to as distance d).

Thereafter, printing of the third to eighth passes is executed by performing the same operation, and the remaining raster lines represented in the drawing are formed (raster lines L3 to L8 written as passes 3 to 8 at the right edge). In this way, by forming raster lines with 8 passes, it becomes possible to have resolution that is 8 times the resolution of the image in the row direction (1440÷180).

With this embodiment, so-called bidirectional printing is performed. Specifically, the direction in which the head 31 (ink discharge nozzle row) moves when printing of the first, third, fifth, and seventh passes is performed and the direction in which the head 31 (ink discharge nozzle row) 31 moves when printing of the second, fourth, sixth, and eighth passes is performed are reverse directions to each other.

However, with this embodiment, color image printing with which a color image (here, an image of a label) is printed and background image printing with which a background image which will be the background of that color image is printed are performed. Then, in this case, the previously described one page of image recording (specifically, image recording by executing image recording passes a plurality of times) is implemented twice (specifically, image recording of the color image and image recording of the background image), and the color image layer (hereafter also called a layer) and the background image layer are overlapped.

Hereafter, as an example of the operation of the image recording device 1, we will describe an example of a case of performing the background image printing process which prints a background image by executing background image recording passes 8 times on the rolled transparent media 2, and performing the color image printing process which prints a color image by executing color image recording passes 8 times after the background image printing process on the rolled transparent media 2.

Image Recording Operation Example for Image Recording Device 1

Figure 7:
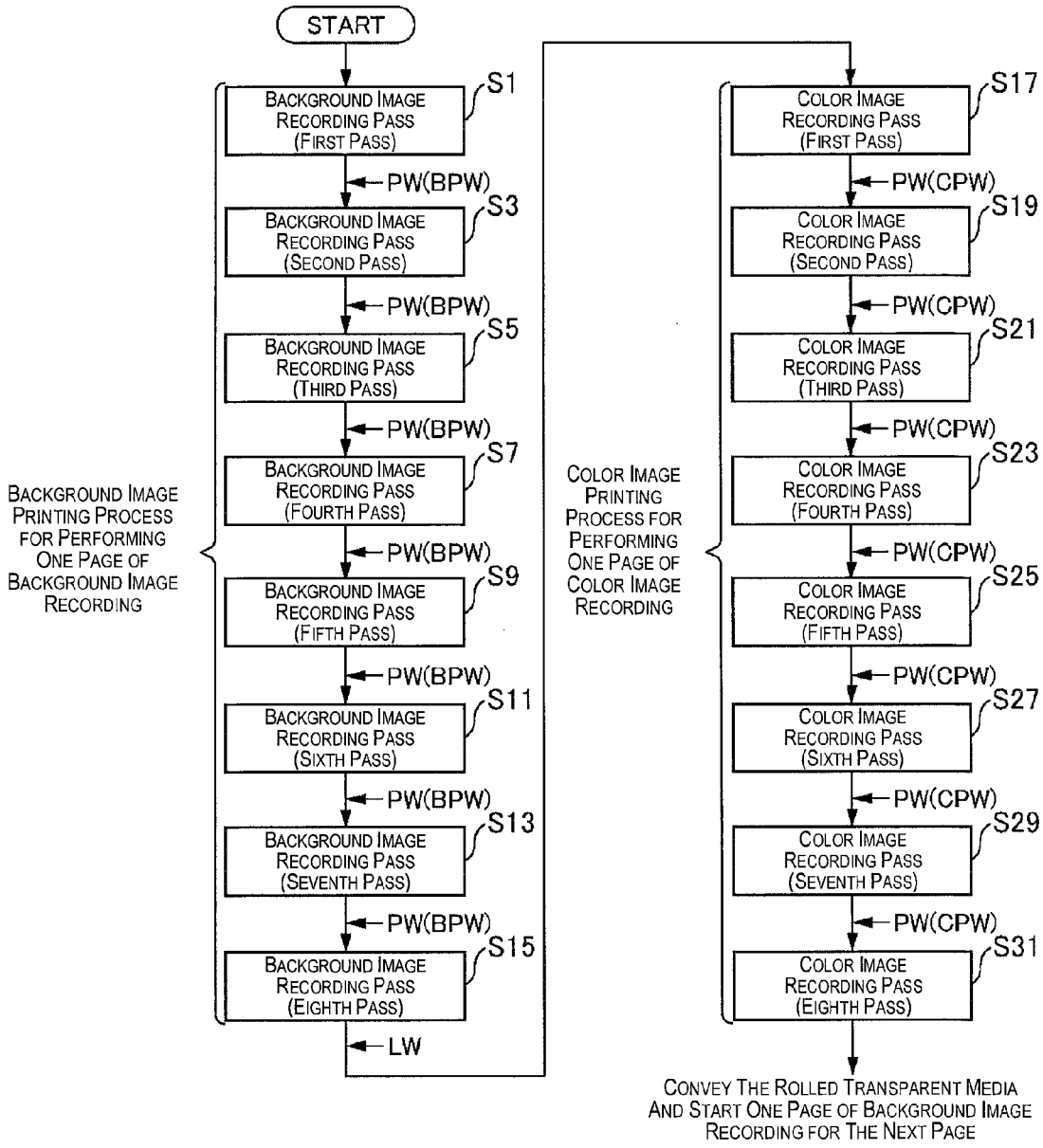
FIG. 7 is an explanatory diagram for describing another example of the image recording operation of the image recording device 1.

Here, we will describe an example of the image recording operation of the image recording device 1 based on the aforementioned case using FIG. 7. FIG. 7 is an explanatory drawing for describing an example of the image recording operation of the image recording device 1. This image recording operation is mainly realized by the controller 60. In particular, with this embodiment, it is realized by the CPU 62 processing the program stored in the memory 63. Also, this program is constituted from a code for performing the various operations described hereafter.

When the rolled transparent media 2 for which the previously described intermittent rolled transparent media 2 conveying was being performed stops, the background image printing process for performing one page of background image recording on the site of the rolled transparent media 2 on the image recording area R is started by the controller 60.

First, the controller 60 executes a first background image recording pass. Specifically, while moving the head 31 in the conveyance direction relative to the rolled transparent media 2 (with this embodiment, moving the head 31 in the conveyance direction), the controller 60 has the head 31 discharge background image ink, and executes the first pass of the background image printing (forming the raster line L1 shown in FIG. 6) (step S1). With this embodiment, a white image (so-called solid white image) is printed as the background image. To do that, white ink is used as the background image ink.

Next, the controller 60 executes the second background image recording pass. Specifically, after moving the head 31 by the distance d in the row direction, the controller 60 has the head 31 discharge white ink while moving the head 31 in the conveyance direction, and executes the second pass of background image printing (forms raster line L2 shown in FIG. 6) (step S3).

Also, by repeatedly performing the same operation as the second background image recording pass 6 times, the third to eighth passes of background image printing (forming raster lines L3 to L8 shown in FIG. 6) are executed by the controller 60 (steps S5, S7, S9, S11, S13, S15).

In this way, the controller 60 executes the background image recording pass by which it has the head 31 discharge background image ink while moving the head 31 in the conveyance direction relative to the rolled transparent media 2 (correlating to the movement direction) a plurality of times (8 times) while changing the relative position of the head 31 in relation to the rolled transparent media 2 in the row direction intersecting with the conveyance direction (correlating to the intersecting direction), to execute the background image printing process by which the background image which is the background of the color image is printed on the rolled transparent media 2. Then, by executing this background image printing process, one page of a solid white image is formed on the rolled transparent media 2.

Next, while maintaining the stopped state of the rolled transparent media 2 from the background image printing process, the color image printing process for performing one page of color image recording (with this embodiment, image recording of a label) on a site of the rolled transparent media 2 on the image recording area R (specifically, the site at which the solid white image is formed) is started by the controller 60.

First, the controller 60 executes the first color image recording pass. Specifically, the controller 60 has the head 31 discharge color image ink while having the head 31 move in the conveyance direction relative to the rolled transparent media 2 (with this embodiment, the head 31 is moved in the conveyance direction) to execute the first pass of color image printing (formation of the raster line L1 shown in FIG. 6) (step S17). With this embodiment, as the color image ink, four colors of ink are used, specifically, yellow ink, magenta ink, cyan ink, and black ink.

Next, the controller 60 executes the second color image recording pass. Specifically, the controller 60 has the head 31 discharge yellow ink, magenta ink, cyan ink, and black ink while moving the head 31 in the conveyance direction after moving the head 31 by the distance d in the row direction to execute the second pass of color image printing (forming rater line L2 shown in FIG. 6) (step S19).

Also, thereafter, by repeatedly performing the same operation as the second color image recording pass 6 times, the third to eighth passes of color image printing (forming raster lines L3 to L8 in FIG. 6) are executed by the controller 60 (steps S21, S23, S25, S27, S29 and S31).

In this way, the controller 60 executes the color image recording pass by which the head 31 is made to discharge the color image ink while moving the head 31 in the conveyance direction (correlates to the movement direction) in relation to the rolled transparent media 2 a plurality of times (8 times) while changing the relative position of the head 31 in relation to the rolled transparent media 2 in the row direction intersecting with the conveyance direction (correlates to the intersecting direction) to execute the color image printing process of printing a color image on the rolled transparent media 2. Also, by executing this color image printing process, one page of a color image (label image) is formed on the rolled transparent media 2. To say this another way, one page of the color image is overlapped on one page of the background image (solid white image) (the color image layer overlaps the background image layer).

Also, when that color image printing process ends, the controller 60 performs the previously described intermittent conveying of the rolled transparent media 2. Then, subsequent to that conveyance, the background image printing process for performing one page of background image recording for the next page is started (see FIG. 7).

In FIG. 7, between each step, a code for PW or LW is noted, and these mean that the wait processes described later are executed. PW is the wait process between passes that is executed between two consecutive passes, and LW is the wait process between layers that is executed between formation of two layers (specifically, the background image layer and the color image layer) (said another way, between the background image printing process and the color image printing process). Also, among the wait processes between passes, the process executed between two consecutive background image recording passes is a wait process between background image recording passes (BPW), and the process executed between two consecutive color image recording passes is the wait process between color image recording passes (CPW). Following, we will give a detailed description of those wait processes.

Wait Processes

Figure 8:
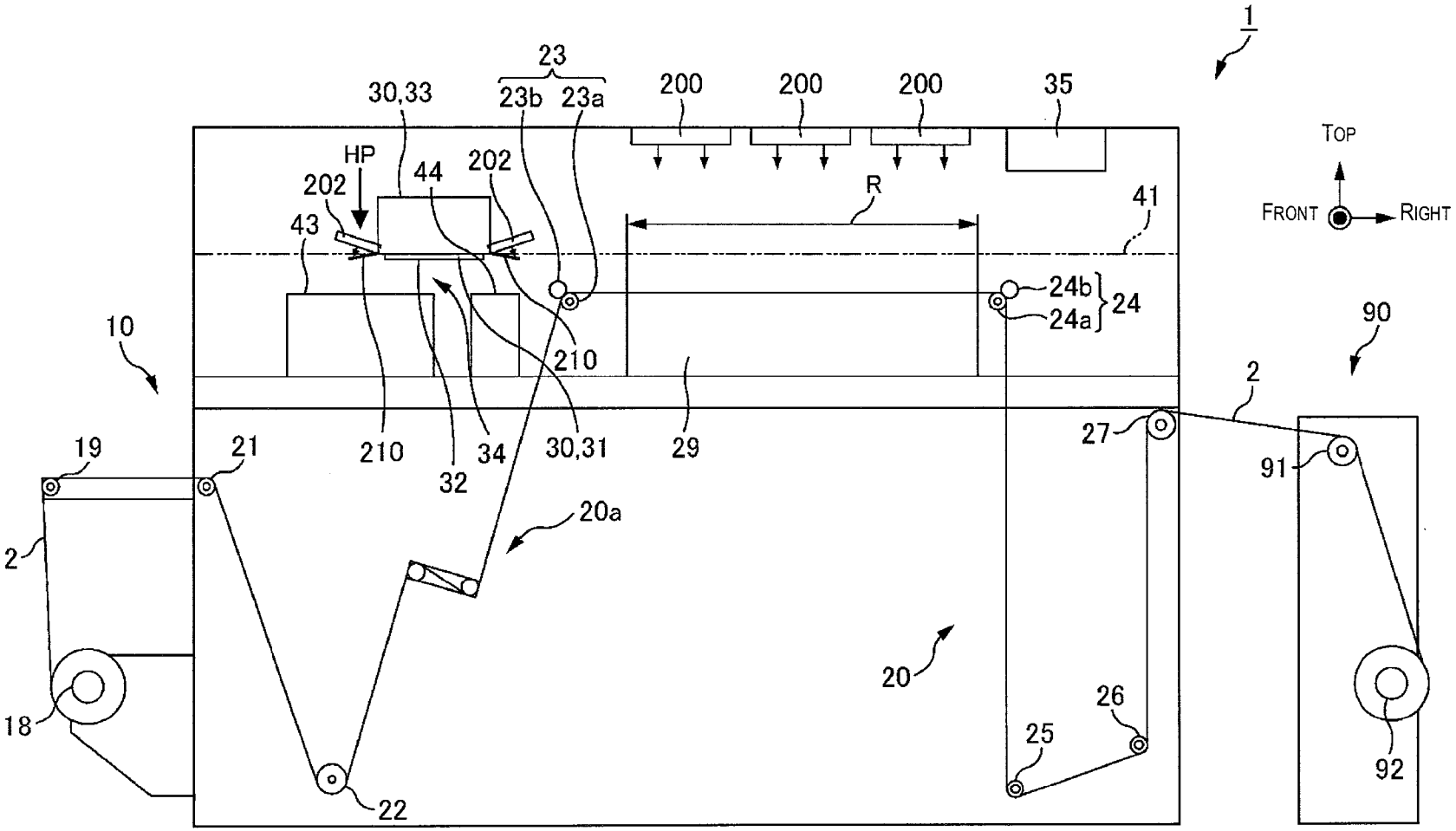
FIG. 8 is a schematic diagram showing the state of the image recording device 1 when the head 31 is positioned at the evacuation position.

Here, we will describe the wait processes using FIG. 7 and FIG. 8. FIG. 8 is a drawing corresponding to FIG. 1, and is a schematic diagram showing the state of the image recording device 1 when the head 31 is positioned in the evacuation position.

The wait process is a process by which the head 31 is moved to the evacuation position to which it was evacuated from above the platen 29 and at which the head 31 is made to wait for a designated wait time in the evacuation position between passes or between layers in order to ensure the time for sufficiently drying the ink impacted on the rolled transparent media 2 by the heat of the platen 29. As described above, as the wait processes, the wait process between passes and the wait process between layers are executed. Following, we will first describe the wait process between passes, and after that, we will describe the wait process between layers.

The wait process between passes is a process of moving the head 31 to the evacuation position to which it was evacuated from above the platen 29 and having the head 31 wait for a designated wait time at the evacuation position (hereafter called the standby process). With this embodiment, as shown in FIG. 7, while performing image recording of one page, the wait process between background image recording passes (BPW) is executed 7 times, and the wait process between color image recording passes (CPW) is executed 7 times, but each wait process between passes is the same, so following, we will describe an example of the wait process between passes between the first background image recording pass and the second background image recording pass.

As described previously, after executing the first background image recording pass (first pass background image printing) at step S1, the controller 60 executes the second background image recording pass (second pass background image printing) at step S3. However, rather than executing the second background image recording pass immediately after executing the first background image recording pass, it executes the second background image recording pass after moving the head 31 to the evacuation position and making it wait for a designated wait time after executing the first background image recording pass.

Specifically, when the controller 60 has finished executing the first background image recording pass, the head 31 is positioned above the platen 29, but the controller 60 moves the head 31 positioned at this position (hereafter referred to as the upward position) to the evacuation position evacuated away from above the platen 29. Here, the evacuation position evacuated from above the platen 29 is a position at which when the head 31 is positioned at that position, the platen 29 does not exist in the vertically downward direction of the head 31, and with this embodiment, is the position shown in FIG. 8, specifically, the position between the previously described cleaning unit 43 and the flushing unit 44. Also, the controller 60 has the head 31 wait for a designated wait time at that evacuation position. When that designated wait time has elapsed, the controller 60 moves the head 31 and positions it at (returns it to) the upward position. Then, after positioning the head 31 at the upward position, the controller 60 starts executing the second background image recording pass.

Also, as the wait process between passes, in addition to the aforementioned standby process, the controller 60 of this embodiment also executes the following two controls on the air blowing unit 80.

First, the controller 60 increases the air speed of the ceiling fan 200 (hereafter, this is also referred to as the ceiling fan acceleration process). When executing the first background image recording pass, the controller 60 controls the ceiling fan 200 to blow air toward the rolled transparent media 2, but it controls it such that the air speed of the ceiling fan 200 at this time is a weak air speed (weak air). This is because when executing passes, if the air speed is a strong air speed (strong air), it is possible that the ink discharged by the head 31 may have flight curve occur, and that ink impact skew may occur. (With the above, we described a case of the ceiling fan windbreak plate 220 blocking the air from the ceiling fan 200 and suppressing that air from being sent to the space 34, but the constitution of the ceiling fan windbreak plate 220 is designed with a prerequisite of being weak air (so that the suppression effect works suitably when at weak air). Therefore, when the air speed is strong air, there is a higher probability of the air circling around to the space 34 even if there is a ceiling fan windbreak plate 220.)

Also, when the controller 60 finishes executing the first background image recording pass and moves the head 31 to the evacuation position, it makes the head 31 wait and also makes the air speed of the ceiling fan 200 a strong air speed (strong air). Specifically, because the possibility of the ink not discharging and the aforementioned flight curve occurring is gone, the controller 60 blows air at a faster air speed than the air speed of the ceiling fan 200 when executing the background image recording pass. When the aforementioned designated wait time has elapsed, the controller 60 returns the air speed of the ceiling fan 200 to weak air. Then, the controller 60 starts execution of the second background image recording pass.

Second, the controller 60 stops blowing of the air by the on-carriage fan 202 (hereafter also referred to as the on-carriage fan stop process). When executing the first background image recording pass, the same as with the ceiling fan 200, the controller 60 controls the on-carriage fan 202 to blow air toward the rolled transparent media 2. This is so that the on-carriage fan 202 supplements the part of the ink drying capacity that dropped due to setting the ceiling fan 200 to weak air. Due to the existence of the windbreak plate 210, there is almost no occurrence of flight curve by the on-carriage fan 202.

Also, after the controller 60 finishes executing the first background image recording pass and moves the head 31 to the evacuation position, it makes the head 31 wait, and stops blowing of the air by the on-carriage fan 202. Specifically, the controller 60 stops blowing air because it is no longer in a state for which the air from the on-carriage fan 202 contacts the background image recording site of the rolled transparent media 2 due to movement of the head 31 to the evacuation position. When the previously described designated wait time has elapsed, the controller 60 starts blowing air again. Then, the controller 60 starts executing the second background image recording pass.

In this way, the wait process between passes with this embodiment is a process consisting of a standby process, a ceiling fan acceleration process, and an on-carriage fan stop process.

As described above, the wait process between passes includes a wait process between background image recording passes and a wait process between color image recording passes, and the same process is performed with the wait process between color image recording passes as with the wait process between background image recording passes. However, the wait time for the aforementioned standby processes are mutually different. Specifically, the controller 60 executes the wait process for both between the plurality of color image recording passes and the plurality of background image recording passes, but that wait process is executed such that the wait time for which the head 31 is made to wait is made to be longer with the latter than with the former. By doing this, the wait time with the wait process between the color image recording passes is shorter than the wait time with the wait process between the background image recording passes.

Next, we will describe the wait process between layers. The wait process between layers is a process by which between layers (specifically, between the background image printing process and the color image printing process), the head 31 is evacuated from above the platen 29 and moved to an evacuation position, and the head 31 is made to wait a designated wait time at the evacuation position. With this embodiment, as shown in FIG. 7, this is executed only one time while one page of image recording is performed.

As described previously, after executing the eighth background image recording pass (eighth pass of background image printing) at step S15, the controller 60 executes a first color image recording pass (first pass of color image printing) at step S17. However, rather than executing the first color image recording pass immediately after executing the eighth background image recording pass, after executing the eighth background image recording pass, the first color image recording pass is executed after executing the wait process described above.

With the wait process between layers as well, the same processes as with the wait process between passes are performed (specifically, in addition to the standby process, the ceiling fan acceleration process and the on-carriage fan stop process). However, the wait times for the standby processes are mutually different. Specifically, the controller 60 executes the wait process for both between passes and between layers, but that wait process is executed such that the wait time for which the head 31 is made to wait is longer with the latter than with the former (in specific terms, more than either between the background image recording passes or between the image recording passes). By doing this, the wait time for the wait process between layers is longer than the wait time for the wait process between passes.

Surface Printing and Back Surface Printing

With the example of the image recording operation described previously using FIG. 7, the controller 60 first performed the background image printing process, and subsequent to that background image printing process, performed the color image printing process. However, as shown in FIG. 9, the controller 60 can also reverse both procedures, specifically, first perform the color image printing process, and subsequent to that color image printing process, perform the background image printing process.

Figure 9:
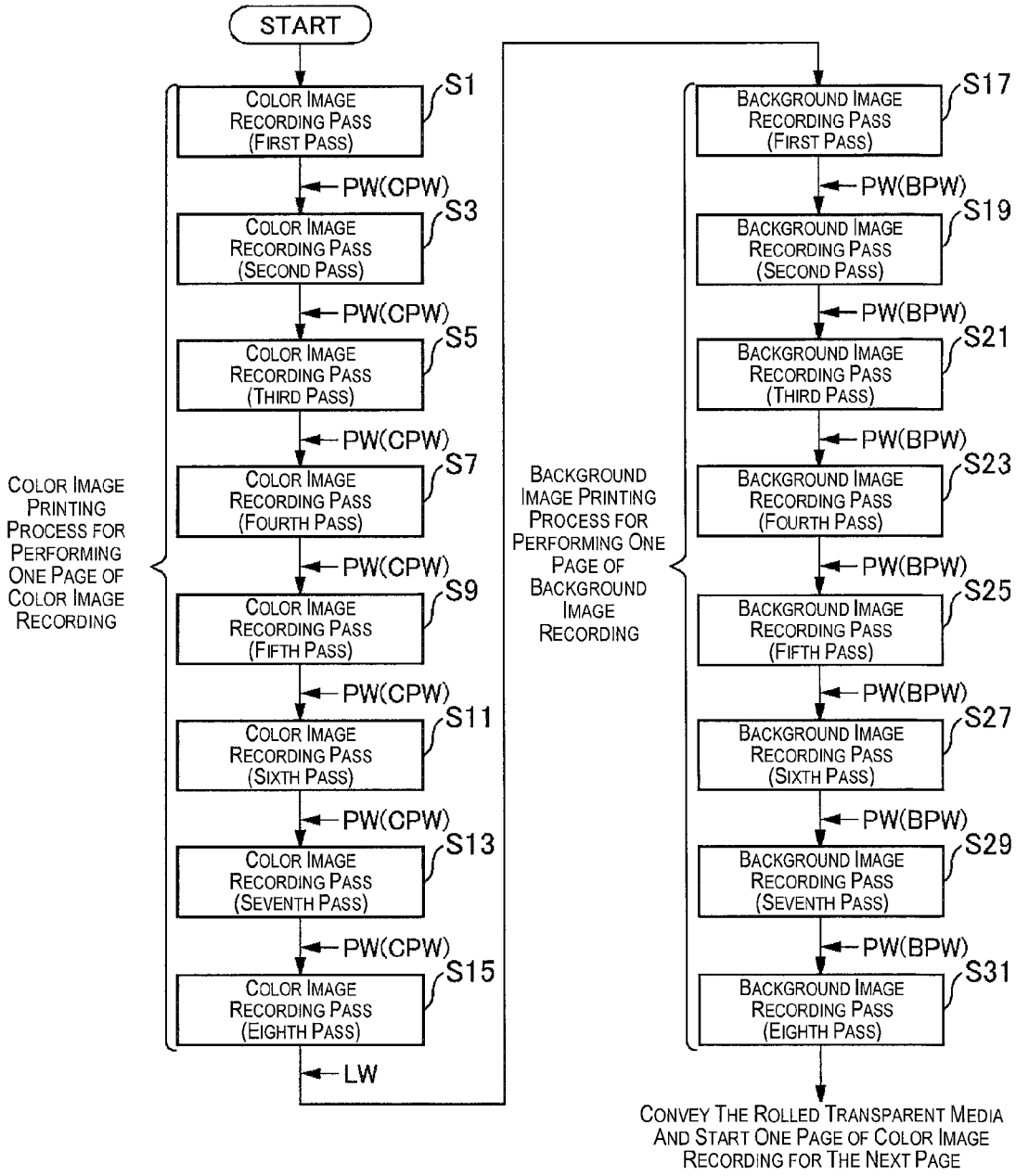
FIG. 9 is an explanatory diagram for describing another example of the image recording operation of the image recording device 1.

Typically, printing by the procedure shown in FIG. 7 and printing by the procedure shown in FIG. 9 are respectively called surface printing and back surface printing. Also, with the image recording device 1 of this embodiment, both printings can be performed. In other words, the controller 60 of this embodiment selectively executes the surface printing process by which the background image printing process is performed, and the color image printing process is performed subsequent to that background image printing process, and the back surface printing process by which the color image printing process is performed, and the background image printing process is performed subsequent to that color image printing process.

Then, as shown in FIG. 9, with the back surface printing process as well, the same as with the surface printing process, while performing one page of image recording, the wait process between color image recording passes is executed 7 times, the wait process between background image recording passes is executed 7 times, and the wait process between layers is executed one time, and with each of the wait processes, the standby process, the ceiling fan acceleration process, and the on-carriage fan stop process are performed. However, with the back surface printing process and the surface printing process, there are the following differences regarding the wait time of the standby process.

First, the controller 60 executes the wait process for both between the plurality of background image record passes with the surface printing process, and between the plurality of background image recording passes with the back surface printing process, but that wait process is executed such that the wait time for which the head 31 is made to wait is longer with the former than with the latter. By doing this, the wait time with the wait process between the background image recording passes with the surface printing process is longer than the wait time with the wait process between the background image recording passes with the back surface printing process.

Second, the controller 60 executes the wait process for both between the background image printing process and the color image printing process with the surface printing process, and between the color image printing process and the background image printing process with the back surface printing process, but that wait process is executed such that the wait time for which the head 31 is made to wait is longer with the former than with the latter. By doing this, the wait time with the wait process between layers with the surface printing process is longer than the wait time with the wait process between layers with the back surface printing process.

Figures 10, 11:
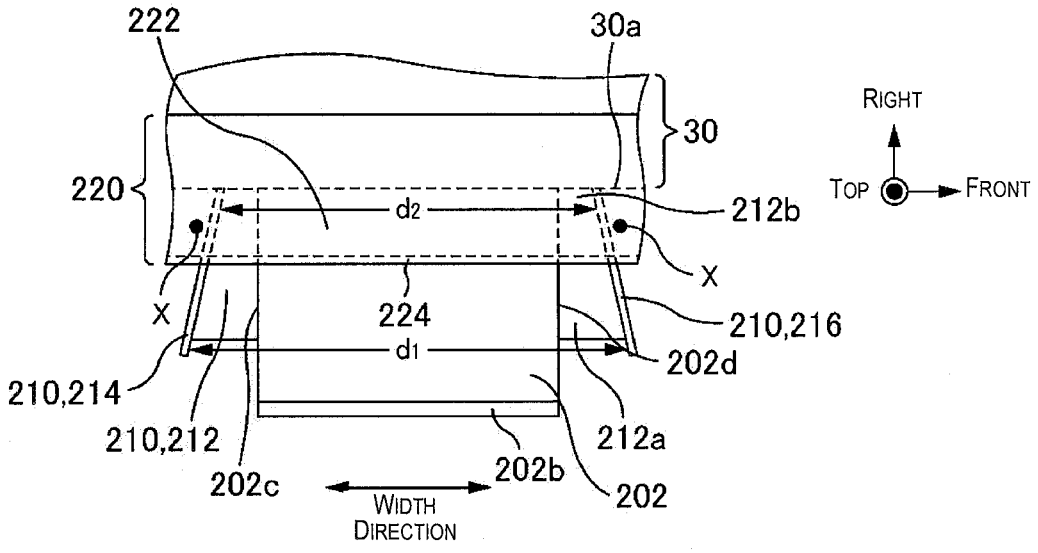
FIG. 10 is a drawing showing the wait time with the standby process.
FIG. 11 is a third pattern diagram showing the constitution of the on-carriage fan 202 and the peripheral members in its periphery with a modification example.

FIG. 10 summarizes the relationship of the wait times described up to now in a table. In the table, T1 to T5 represent times, and T1<T2<T3<T4<T5. With this embodiment, T1, T2, T3, T4, and T5 are set respectively to 1 second, 1.3 seconds, 1.5 seconds, 3 seconds, and 4 seconds.

Effectiveness of Image Recording Device 1 of This Embodiment

As described above, the image recording device 1 of this embodiment has the platen 29 that supports the rolled transparent media 2, the head unit 30 for discharging ink on the rolled transparent media 2 supported by the platen 29, and the on-carriage fan 202 provided on the head unit 30 for sending air toward the rolled transparent media 2 supported by the platen 29. Then, the on-carriage fan 202 is attached to the head unit 30 such that the direction of the air sent by the on-carriage fan 202 toward the rolled transparent media 2 is not the normal line direction of the rolled transparent media 2, but is a diagonally downward direction at an angle to that normal line direction. Because of that, it is possible to blow the air on a broad range of the rolled transparent media 2, and therefore, it is possible to more suitably dry the ink impacted on the rolled transparent media 2.

Also, with this embodiment, the nozzle surface 32 having ink discharge nozzles for discharging ink is provided on the bottom surface of the head unit 30, and it further has the windbreak plate 210 for suppressing the air from being sent to the space 34 between the nozzle surface 32 and the rolled transparent media 2 by blocking the air. Because of that, it is possible to inhibit the problem of air that has been dispersed in a broad range circling around to the space 34 and causing flight curve of the ink droplets at that space 34.

Also, with this embodiment, the image recording device 1 is equipped with the conveyor unit 20 that conveys the rolled transparent media 2 in the conveyance direction, and the on-carriage fan 202 is attached to the side edge part 30*a* of the head unit 30 in that conveyance direction, the windbreak plate 210 extends from the head unit 30 and has a downward extension plate 212 positioned below the on-carriage fan 202. Because of that, as described previously, the downward extension plate 212 is positioned between the on-carriage fan 202 and the space 34. Therefore, it is possible for the air sent by the on-carriage fan 101 to be blocked and to effectively suppress sending of that air to the space 34.

Also, with this embodiment, the image recording device 1 is fixed to the image recording device main unit, and it further has the ceiling fan 200 for sending air toward the rolled transparent media 2 supported by the platen 29, and the ceiling fan windbreak plate 220 for suppressing sending of the air to the space 34 by blocking the air sent by the ceiling fan 200. Because of that, it is possible to inhibit the problem of the air from the ceiling fan 200 circling around to the space 34 and causing flight curve of the ink droplets in that space 34.

Other Embodiments

The embodiment noted above was mainly noted regarding the liquid discharge device, but it also includes disclosure of an air blowing method and the like. Also, the embodiment noted above is for making the present invention easier to understand, and is not to be interpreted as limiting the present invention. It goes without saying that the present invention can be modified or reformed without straying from its gist, and that equivalent items thereof are included in the present invention. In particular, the embodiments described hereafter are also included in the present invention.

With the embodiment noted above, the liquid discharge device (liquid spraying device) was put into specific form as an inkjet printer, but it is also possible to make it into a specific form as a liquid spraying device that sprays or discharges a liquid other than ink, and various types of liquid spraying device equipped with a liquid spray head or the like for discharging tiny volume droplets can be appropriated for this. Droplets means the state of liquid discharged from the aforementioned liquid spraying device, and includes granular shapes, tear shapes, and threadlike shapes with a tail. Also, what is called liquid here is sufficient as long as it is a material that can be sprayed by the liquid spraying device. For example, it is sufficient as long as it is an item in a state when the property is liquid phase, and includes not only liquid bodies with high or low viscosity, fluid bodies such as sol, gel water, other inorganic solvents, organic solvents, solutions, liquid resin, liquid metal (metal melt), or a liquid as one state of a substance, but also includes items such as items for which particles of functional materials consisting of a solid such as a pigment, metal particle or the like is dissolved, dispersed, or blended in a solvent. Also, as a representative example of a liquid, we can list the ink or liquid crystal or the like such as those described with the embodiment noted above. Here, ink includes typical water based inks, oil based inks, as well as various liquid compositions such as gel ink, hot melt ink and the like. As specific examples of the liquid spraying device, for example, there are liquid spraying devices which spray liquid including materials such as electrode materials or coloring materials or the like in a dispersed or dissolved form used in manufacturing items such as liquid crystal displays, EL (electro luminescence) displays, surface light emitting displays, color filters and the like, and it is also possible to be a liquid spraying device for spraying bioorganic material used for biochip manufacturing, a liquid spraying device for spraying a liquid that will be a sample used for a precision pipette, a textile printing device, a micro dispenser, other pi or the like. Furthermore, it is also possible to use a liquid spraying device for spraying lubricating oil with a pinpoint on precision machines such as watches, cameras or the like, a liquid spraying device for spraying a transparent resin liquid such a ultraviolet curing resin or the like for forming a miniature hemispheric lens (optical lens) used for optical communication elements or the like on a substrate, or a liquid spraying device for spraying an acid or alkaline or the like etching fluid for etching a substrate or the like. Then, it is possible to apply the present invention to any one type of liquid spraying device among these.

Also, we described the embodiment noted above using an example of the rolled transparent media 2 as the media, but the invention is not limited to this, and for example can also be cut media, or can be media that is not transparent.

Also, as shown in FIG. 5, with the embodiment noted above, the downward extension plate 212 had a rectangular shape (therefore it was arranged so that the first side plate 214 and the second side plate 216 are parallel), but as shown in FIG. 11, it is also possible for the downward extension plate 212 to have a trapezoidal shape. Specifically, it is also possible for the first side plate 214 and the second side plate 216 to not be parallel, but rather for the distance d1 between the front edge parts of the first side plate 214 and the second side plate 216 to be greater than the distance d2 between the base parts of the first side plate 214 and the second side plate 216.

Then, in that case, it is possible to widely disperse the air from the on-carriage fan 202 in the width direction of the rolled transparent media 2, and therefore, it is possible to blow the air in a broader range of the rolled transparent media 2. Because of that, it is possible to more suitably dry the ink impacted on the rolled transparent media 2.

As a result, the on-carriage fan 202 does not have to be provided across the length of the width direction of the rolled transparent media 2 intersecting the conveyance direction, but rather as long as the following formulas are satisfied, it is possible to blow the air in a broader range on the rolled transparent media.

Specifically, when the width direction length of the head unit (or the width direction length of the platen intersecting with the conveyance direction) is L1, and the width direction length of the on-carriage fan 202 equipped at the center part of the side edge part 30*a* of the head unit 30 is L2, L1 and L2 satisfy formula 1.

$$L1 \geq L2 \quad \text{(Formula 1)}$$

Furthermore, as a result of experiment, when L1 and L2 satisfy formula 2, it was possible to sufficiently dry the ink impacted on the rolled transparent media.

$$\tfrac{1}{2}L1 \geq L2 \geq \tfrac{1}{4}-1 \quad \text{(Formula 2)}$$

Figure 12:
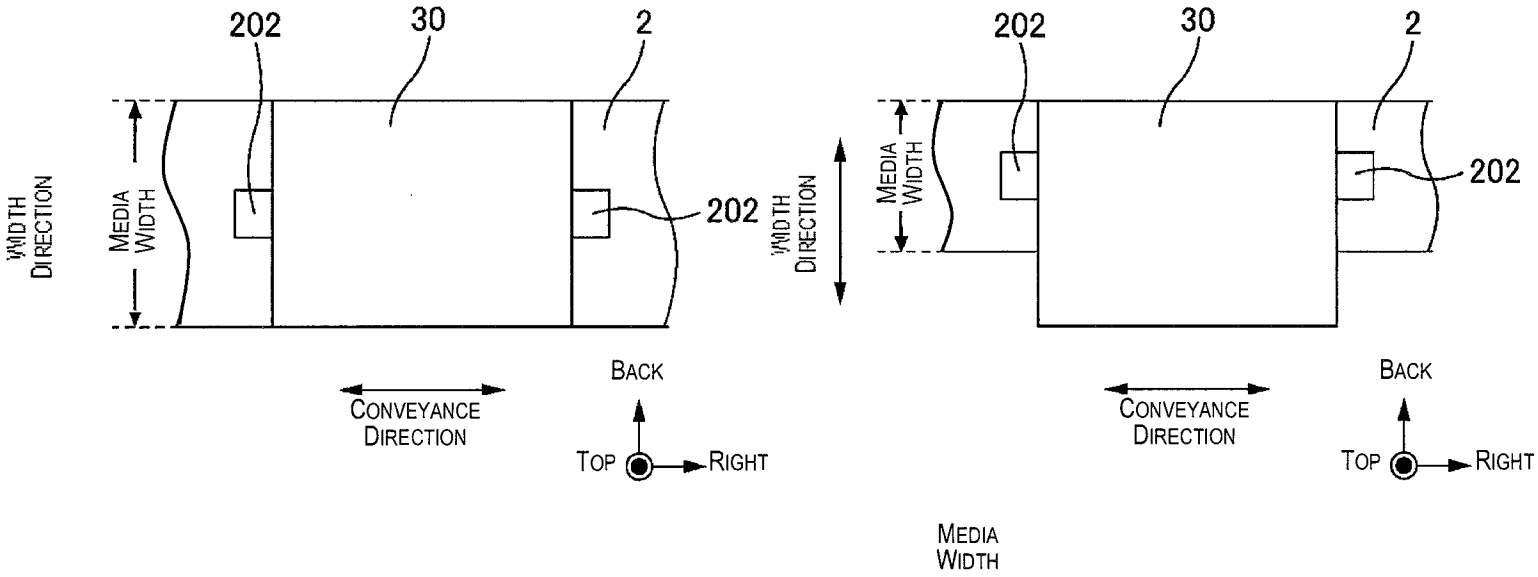
FIG. 12 is a pattern diagram showing the status when the on-carriage fan 202 moves relatively according to the media width.

Also, with the embodiment noted above, the on-carriage fan 202 had a constitution for which it was not possible to move in the width direction of the rolled transparent media 2 in relation to the head unit 30, but as shown in FIG. 12, it is also possible to have the on-carriage fan 202 attached so as to be able to move freely relative to the head unit 30 in the width direction.

Then, in this case, by moving the on-carriage fan 202 relatively in the width direction according to the length of the rolled transparent media 2 in the width direction (hereafter called the media width), the air sent by the on-carriage fan 202 can always be made to face toward the center part in the width direction of the rolled transparent media 2 (in cases when the media width of the rolled transparent media 2 is large, see the left diagram in FIG. 12, and in cases when it is small, see the right diagram in FIG. 12). Therefore, it is possible to more suitably dry the ink impacted on the rolled transparent media 2.

In this kind of case, the windbreak plate 210 (not illustrated in FIG. 12) can also, as an integrated unit with the on-carriage fan 202, move relatively in the width direction in relation to the head unit 30, and it is also possible to make the distance between the first side plate 214 and the second side plate 216 longer (therefore, the downward extension plate 212 must also necessarily be a long plate in the width direction), and to be able to move the on-carriage fan 202 relatively between the first side plate 214 and the second side plate 216.

Also, with the embodiment noted above, we described an example of a lateral scan type label printing apparatus as the liquid discharge device, but the invention is not limited to this, and for example it is also possible to use a serial scan type large format printer.

Figure 13:
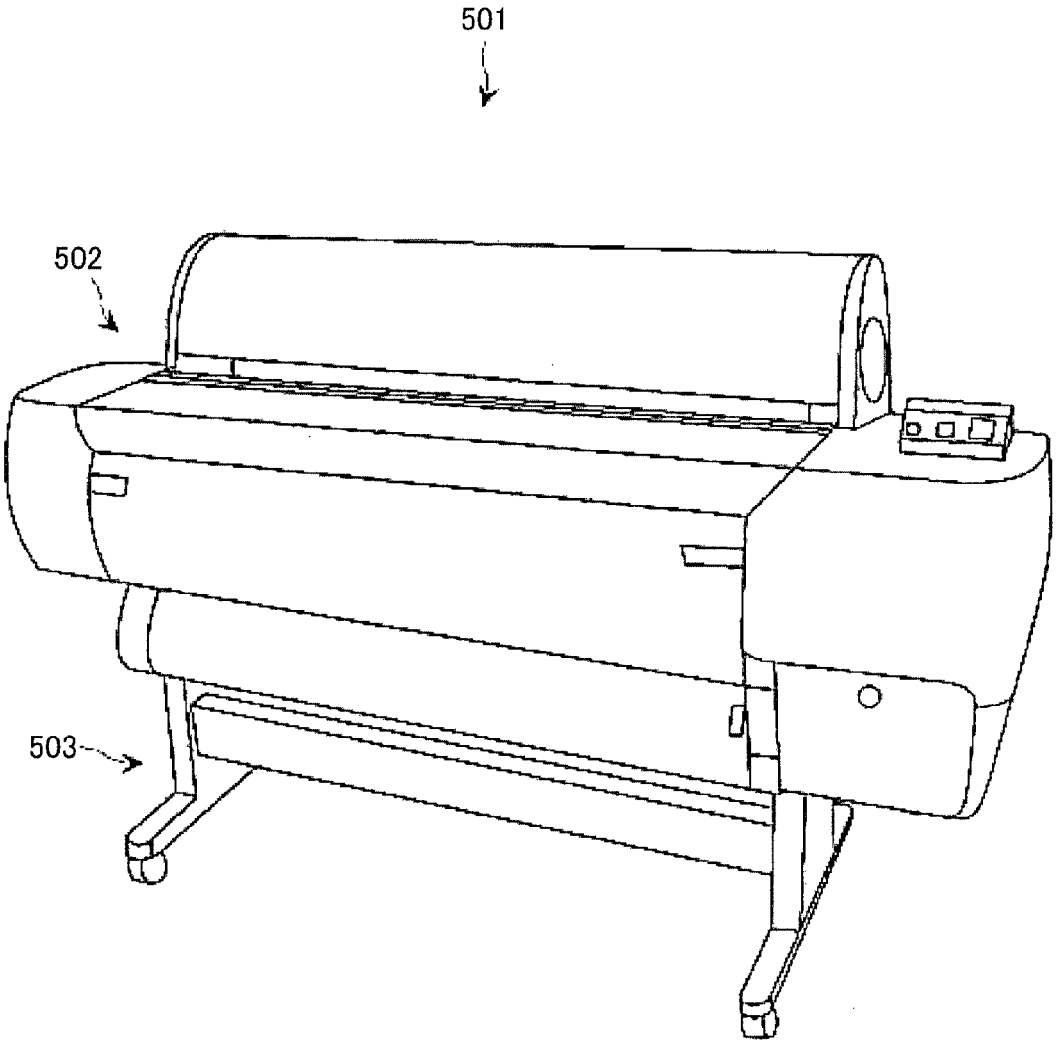
FIG. 13 is an external view pattern diagram of an inkjet printer 501.
Figure 14:
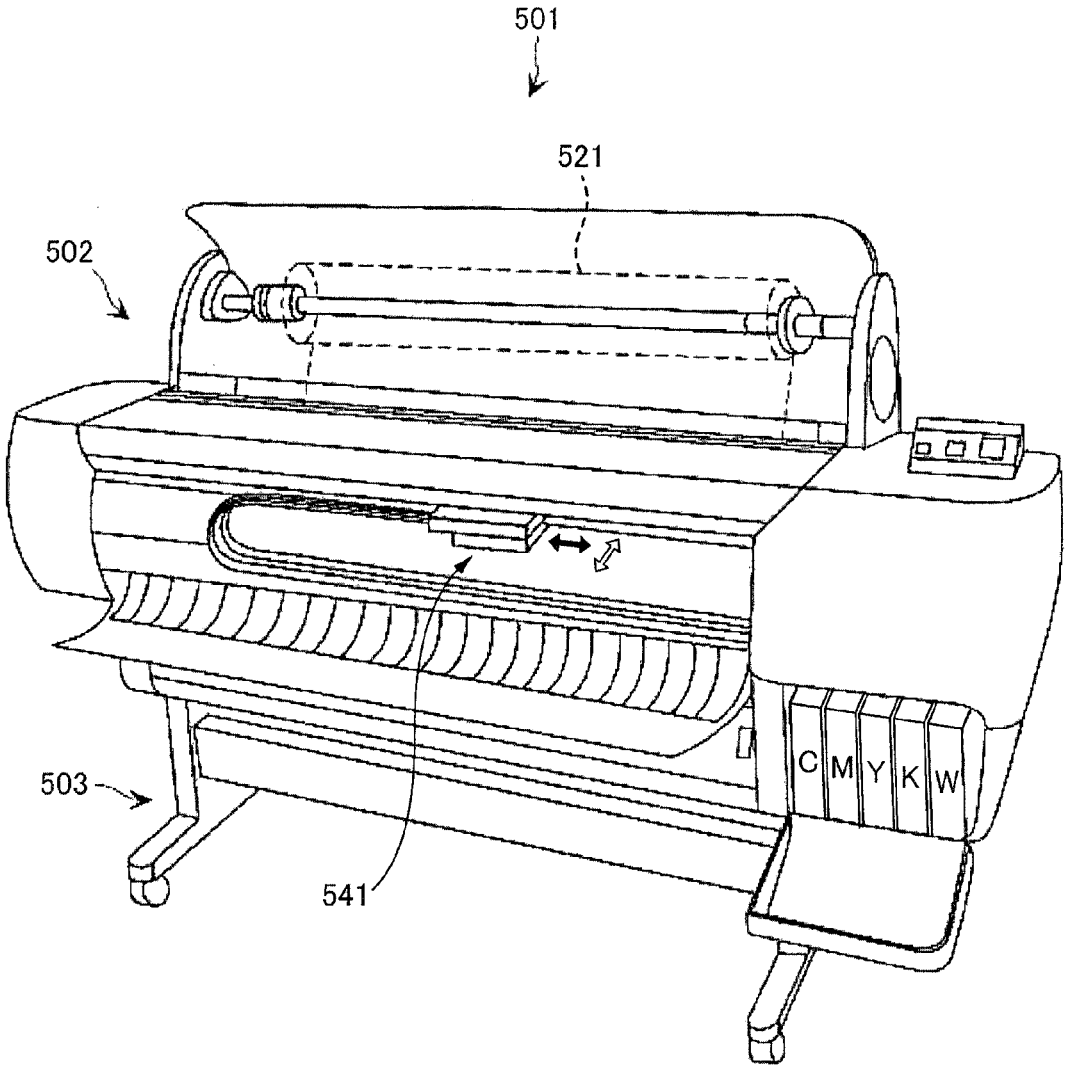
FIG. 14 is a schematic diagram showing the constitution of the inkjet printer 501.

Following, we will describe that serial scan type large format printer (hereafter called the inkjet printer 501) using FIG. 13 and FIG. 14. FIG. 13 is an external view schematic drawing showing the inkjet printer 501. FIG. 14 is a schematic drawing showing the constitution of the inkjet printer 501.

As shown in FIG. 13 and FIG. 14, the inkjet printer 501 is equipped with a printer main unit 502 and a support stand 503 for supporting the printer main unit 502. This inkjet printer 501 is equipped with a platen (not illustrated) that supports and heats the rolled transparent media 521, an inkjet head 541 that discharges color image ink and background image ink on the rolled transparent media 521 supported by the platen, and a controller. Then, for this inkjet printer 501 as well, the previously described background image printing process and the color image printing process are executed by the controller.

To describe an example of the surface printing process, the controller first executes a plurality of times the background image recording pass by which the inkjet head 541 is made to discharge background image ink while moving the inkjet head 541 in the movement direction (in FIG. 14, the direction shown by the thick black arrow) relative to the rolled transparent media 521, changing the relative position of the inkjet head 541 in relation to the rolled transparent media 521 in the intersecting direction intersecting with the movement direction (in FIG. 14, the direction shown by the thick white arrow), and executes the background image printing process by which the background image which is the background for the color image is printed on the rolled transparent media 521.

Here, the same as with the label printing apparatus described above, the controller executes the background image recording pass by having the inkjet head 541 discharge background image ink while moving the inkjet head 541 in the movement direction in relation to the rolled transparent media 521. However, with the label printing apparatus, when executing that background image recording pass a plurality of times changing the relative position of the inkjet head 541 in relation to the rolled transparent media 521 in the intersecting direction, that relative position was changed by moving the inkjet head 541 in the intersecting direction, and in contrast to that, with the inkjet printer 501, at that time, that relative position is changed by moving the rolled transparent media 521 in the intersecting direction. In other words, with the inkjet printer 501, in contrast to the label printing apparatus, the controller executes the background image printing process while sending the rolled transparent media 521 in the conveyance direction (specifically, the intersecting direction).

After finishing the execution of the background image printing process, the controller subsequently executes the color image printing process, but before executing the color image printing process, it does back feeding of the rolled transparent media 521 by the conveyance amount of the portion sent with the background image printing process.

Next, the controller executes the color image printing process for printing the color image on the rolled transparent media 521 by executing a plurality of times the color image recording pass by which the inkjet head 541 is made to discharge color image ink while moving the inkjet head 541 in the movement direction (in FIG. 14, the direction shown by the thick black arrow) relative to the rolled transparent media 521, changing the relative position of the inkjet head 541 to the rolled transparent media 521 in the intersecting direction that intersects the movement direction (in FIG. 14, the direction shown by the thick white arrow).

In that case as well, when the controller executes a plurality of times the color image recording pass by having the inkjet head 541 discharge color image ink while moving the inkjet head 541 in the movement direction in relation to the rolled transparent media 521, changing the relative position of the inkjet head 541 in relation to the rolled transparent media 521 in the intersecting direction of that color image recording pass, it changes that relative position by moving the rolled transparent media 521 in the intersecting direction.

Then, it is also possible to perform the wait process between passes provided with the standby process described above between background image recording passes and between the color image recording passes of this kind of background image printing process and color image printing process.

It is also possible to provide a ceiling fan and on-carriage fan on the inkjet printer 501 shown in FIG. 13 and FIG. 14, and to execute the previously described ceiling fan acceleration process and the on-carrier fan stop process with the wait process between passes.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid discharge device comprising:

a platen configured and arranged to support a medium;

a head unit configured and arranged to discharge liquid on the medium supported by the platen, a bottom surface of the head unit including a nozzle surface having a plurality of nozzles configured and arranged to discharge the liquid; an air blower including a fan configured and arranged to send air toward the medium supported by the platen, the fan being attached to a side edge part of the head unit such that an axis of the fan extends along a direction that is at an angle to a normal line direction of the medium and that intersects the medium and such that a first side surface of the fan disposed adjacent to the side edge part of the head unit is positioned further downward than a second side surface of the fan, which is disposed further away from the side edge part of the head unit than the first side surface; and an air blocking unit configured and arranged to suppress sending of air to a space between the nozzle surface and the medium by blocking the air.

2. The liquid discharge device according to claim 1, further comprising a conveyor part configured and arranged to convey the medium in a conveyance direction, wherein the air blower is attached to a side edge part of the head unit with respect to the conveyance direction, the air blocking unit is a windbreak plate, and the windbreak plate has a downward extension plate extending from the head unit and positioned below the air blower.

3. The liquid discharge device according to claim 2, wherein the air blower is attached to be able to freely move relative to the head unit in a width direction of the medium intersecting with the conveyance direction.

4. The liquid discharge device according to claim 1, wherein the air blower is a moving air blower, the liquid discharge device further includes a fixed air blower fixed to a liquid discharge device main unit to send air toward the medium supported by the platen, and a second air blocking unit configured and arranged to suppress sending of the air to the space by blocking the air sent by the fixed air blower.

5. The liquid discharge device according to claim 1, further comprising a conveyor part configured and arranged to convey the medium in a conveyance direction, the air blower being attached to the head unit on at least one of an upstream side and a downstream side of the head unit with respect to the conveyance direction.

6. A liquid discharge device comprising:

a platen configured and arranged to support a medium;

a conveyor part configured and arranged to convey the medium in a conveyance direction;

a head unit configured and arranged to discharge liquid on the medium supported by the platen, a bottom surface of the head unit including a nozzle surface having a plurality of nozzles configured and arranged to discharge the liquid;

an air blower configured and arranged to send air toward the medium supported by the platen, the air blower being attached to a side edge part of the head unit with respect to the conveyance direction such that the air sent by the air blower toward the medium flows in a direction at an angle to a normal line direction of the medium; and an air blocking unit configured and arranged to suppress sending of air to a space between the nozzle surface and the medium by blocking the air, the air blocking unit being a windbreak plate having a downward extension plate extending from the head unit and positioned below the air blower, wherein the windbreak plate further includes a first side edge part opposing plate connected to the downward extension plate and facing one of side edge parts of the air blower in a width direction of the medium intersecting the conveyance direction, and a second side edge part opposing plate connected to the downward extension plate and facing the other one of the side edge parts of the air blower in the width direction, the air blower is surrounded from both sides and underneath by the downward extension plate, the first side edge part opposing plate, and the second side edge part opposing plate, and a distance between front edge parts of the first side edge part opposing plate and the second side edge part opposing plate is greater than a distance between base parts of the first side edge part opposing plate and the second side edge part opposing plate.

* * * * *